US011320231B2

(12) United States Patent
Williams

(10) Patent No.: US 11,320,231 B2
(45) Date of Patent: May 3, 2022

(54) DOUBLE CROSSBOW

(71) Applicant: Robert Wyn Williams, London (GB)

(72) Inventor: Robert Wyn Williams, London (GB)

( * ) Notice: Subject to any disclaimer, the term of this patent is extended or adjusted under 35 U.S.C. 154(b) by 0 days.

(21) Appl. No.: 17/131,513

(22) Filed: Dec. 22, 2020

(65) Prior Publication Data

US 2021/0164753 A1 Jun. 3, 2021

Related U.S. Application Data

(63) Continuation of application No. 16/602,754, filed on Dec. 3, 2019, now abandoned.

(51) Int. Cl.
*F41B 5/12* (2006.01)

(52) U.S. Cl.
CPC ..... *F41B 5/126* (2013.01); *F41B 5/12* (2013.01)

(58) Field of Classification Search
CPC ..... F41B 5/12; F41B 5/123; F41B 5/126
See application file for complete search history.

(56) References Cited

U.S. PATENT DOCUMENTS 2,997,998 A * 8/1961 Traise ..... F41B 7/043 124/22
3,741,190 A * 6/1973 Lopez ..... A01K 81/00 124/22
4,722,318 A * 2/1988 Yankey ..... F41B 5/143 124/25
5,372,118 A * 12/1994 Schmidt, III ..... F41B 7/04 124/20.3
5,437,260 A * 8/1995 King ..... F41B 5/12 124/25
5,649,521 A * 7/1997 King ..... F41B 5/126 124/25
6,708,683 B1 * 3/2004 Harris ..... F41B 7/04 124/20.3
6,868,845 B1 * 3/2005 Moore ..... F41B 5/126 124/25
6,874,491 B2 * 4/2005 Bednar ..... F41B 5/10 124/25
6,953,034 B2 * 10/2005 May ..... A01K 81/00 124/17
7,077,119 B1 * 7/2006 Dube, Sr ..... F41B 5/12 124/25.5
9,255,754 B1 * 2/2016 Kempf ..... F41B 5/12
9,506,715 B2 * 11/2016 Hughes ..... F41A 17/00
9,551,544 B1 * 1/2017 Kempf ..... F41B 5/12
9,557,134 B1 * 1/2017 Yehle ..... F41A 19/10
(Continued)

*Primary Examiner* — John A Ricci
(74) *Attorney, Agent, or Firm* — Ashok Tankha

(57) ABSTRACT

A double crossbow with a single trigger mechanism is provided. The double crossbow comprises a barrel, an upper bow, a lower bow, and a single trigger mechanism. The upper bow and the lower bow are positioned on top of each other at a distal end of the barrel. The single trigger mechanism positioned at a proximal end of the barrel is configured to shoot two arrows in succession without reloading an arrow between two shots. A first arrow is shot from the upper bow when a single trigger of the single trigger mechanism is squeezed completely a first time, and the second arrow is shot from the lower bow when the single trigger of the single trigger mechanism is squeezed completely a second time. The single trigger mechanism is configured to not shoot the first arrow and the second arrow simultaneously.

19 Claims, 11 Drawing Sheets

(56) References Cited

U.S. PATENT DOCUMENTS

| | | | | |
|---|---|---|---|---|
| 10,012,468 | B1 * | 7/2018 | Kempf | F41B 5/12 |
| 2013/0098343 | A1 * | 4/2013 | Grace | F41B 5/123 124/25 |
| 2019/0331453 | A1 * | 10/2019 | Zou | F41B 5/126 |
| 2020/0224993 | A1 * | 7/2020 | Egerdee | F41B 5/126 |

* cited by examiner

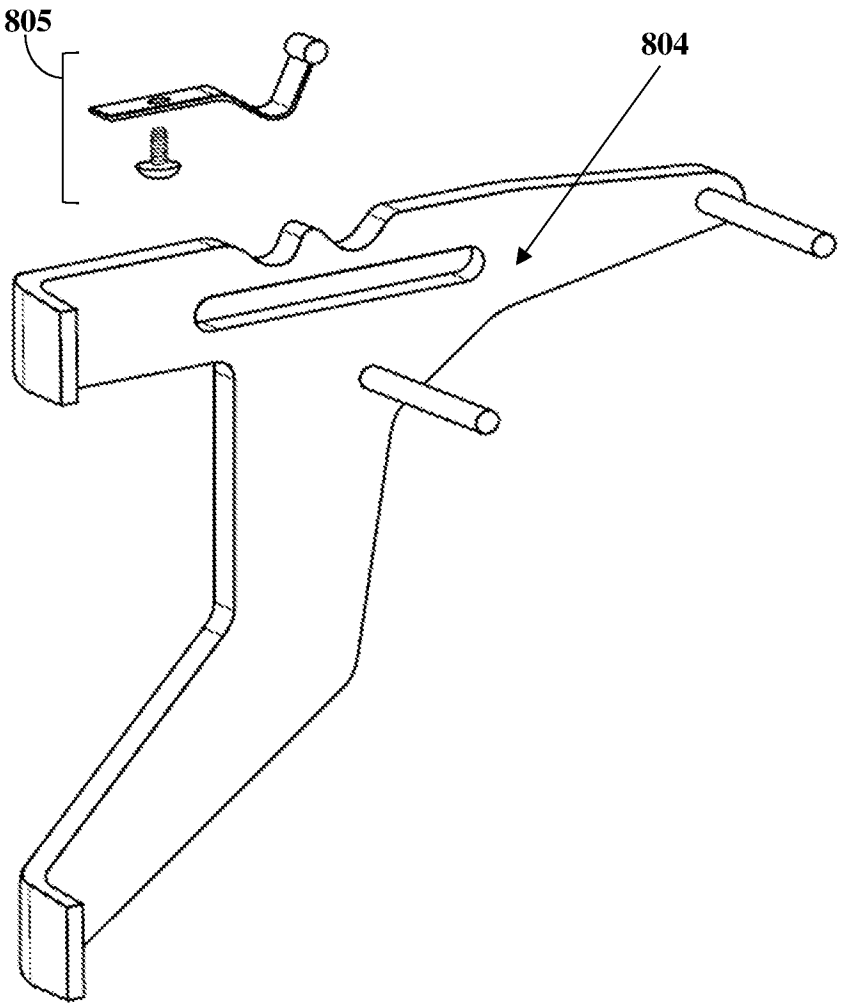
FIG. 9B
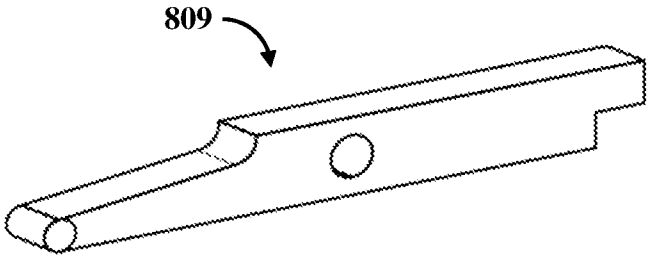

DOUBLE CROSSBOW

CROSS REFERENCE TO RELATED APPLICATIONS

This application is a continuation in part application of non-provisional patent application Ser. No. 16/602,754, titled "Double Crossbow", filed in the United States Patent and Trademark Office on Dec. 3, 2019.

FIELD OF THE INVENTION

The present invention, in general, relates to a device for firing multiple arrows onto a target without having to reload between the shots, and more particularly, relates to a double crossbow.

BACKGROUND

In many parts of the world, bowhunting is a popular way of hunting and controlling population of animals, for example, deer, duck, etc. In the United States of America, a special archery season is set aside for hunting animals. Typical bowhunting requires people to hunt the animals using a crossbow, or a bow and arrow. Typically, an archer can only shoot a single arrow at a time with the crossbow, or the bow and arrow. Oftentimes, people need to have more than one arrow in the crossbow, ready for shooting the second arrow in quick succession, without having to reload a fresh arrow into the crossbow after the first arrow is shot. Availability of multiple arrows in the crossbow, ready for shooting in quick succession, allows an archer to have a greater chance of killing the animal or not being detected by deer and other animals, which were called into a hunter's firing range or encountered in the normal parameters of hunting.

In general, people who are target shooting or bowhunting, often need to fire subsequent arrows after firing the first arrow, to hit the target or kill the animal or subsequent animals that need to be shot. Traditional crossbows require a second arrow to be selected, fixed in the crossbow and the string drawn. Each of these activities distract the focus of the archer or the hunter away from the target or animal, requiring him or her to do additional work by moving his or her limbs and other body parts. Furthermore, there is a high possibility that the archer or the hunter makes some noise while moving his or her limbs and other body parts, which could alert the animal. In some areas it is possible that one or more dangerous wild animals may arrive in response to a calling by a first animal, indicating the presence of a dead animal or animals, or just by virtue of being in the area. Hence, there is a long felt need for a device that can be loaded with two arrows that are configured to be fired in quick succession, when a safety catch is released and a trigger is pulled on a double cross-bow in a normal way.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

A double crossbow with a single trigger mechanism disclosed herein addresses the above recited need for a device that can be loaded with two arrows and that is ready to fire both the arrows in quick succession, when a safety catch is released and a trigger is pulled in a normal way. The double crossbow with the single trigger mechanism disclosed herein comprises a barrel, an upper bow, a lower bow, and a single trigger mechanism. The double crossbow is manufactured using one or more of wood, metals, plastic, composite and fibreglass materials, with a variety of finishes applied to the manufactured double crossbow. The upper bow and the lower bow are disposed one on top of each other at a distal end of the barrel. The upper bow comprises a pair of split limbs with a first and a second end, a riser to receive the first end of the pair of split limbs, a cam affixed to the second end of each of the split limbs of the upper bow, a first cable affixed to the second end of each of the split limbs of the upper bow, and a first string extending from the cams of the upper bow to a top sear of the single trigger mechanism. The first cable works in tandem with the cams of the upper bow which is configured to adjust the shooting power of the upper bow.

The lower bow comprises a pair of split limbs with a first end and a second end, a riser to receive the first end of the pair of split limbs, a cam affixed to the second end of each of the split limbs of the lower bow, a second cable affixed to the second end of each of the split limbs of the lower bow, and a second string extending from the cams of the lower bow to a bottom sear of the single trigger mechanism. The second cable works in tandem with the cams of the lower bow to adjust the shooting power of the lower bow. The first arrow is loaded into the upper bow disposed on top of the barrel, and the second arrow is loaded into the lower bow disposed at the bottom of the barrel. The first arrow and the second arrow can be loaded individually in the double crossbow and one of the first arrow and the second arrow is shot in succession when the single trigger is squeezed in succession. The double crossbow further comprises a cocking rope configured to cock the first string of the upper bow and the second string of the lower bow to the top and bottom sears of the single trigger mechanism.

The single trigger mechanism is positioned at a proximal end of the barrel and is configured to shoot two arrows in succession without the need for reloading an arrow between the shooting of the two arrows. The top sear and bottom sear of the single trigger mechanism are configured to hold the first string and the second string before shooting. A first arrow is shot from the upper bow when a single trigger of the single trigger mechanism is squeezed completely a first time. Thereafter, a second arrow is shot from the lower bow when the single trigger of the single trigger mechanism is squeezed completely a second time. The single trigger mechanism is configured to not shoot the first arrow and the second arrow simultaneously. The double crossbow further comprises a safety catch to prevent the first arrow and the second arrow from being released accidentally.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein.

FIGS. 9A-9C exemplarily illustrate components of a single trigger mechanism.

DETAILED DESCRIPTION OF THE INVENTION

Figure 1:
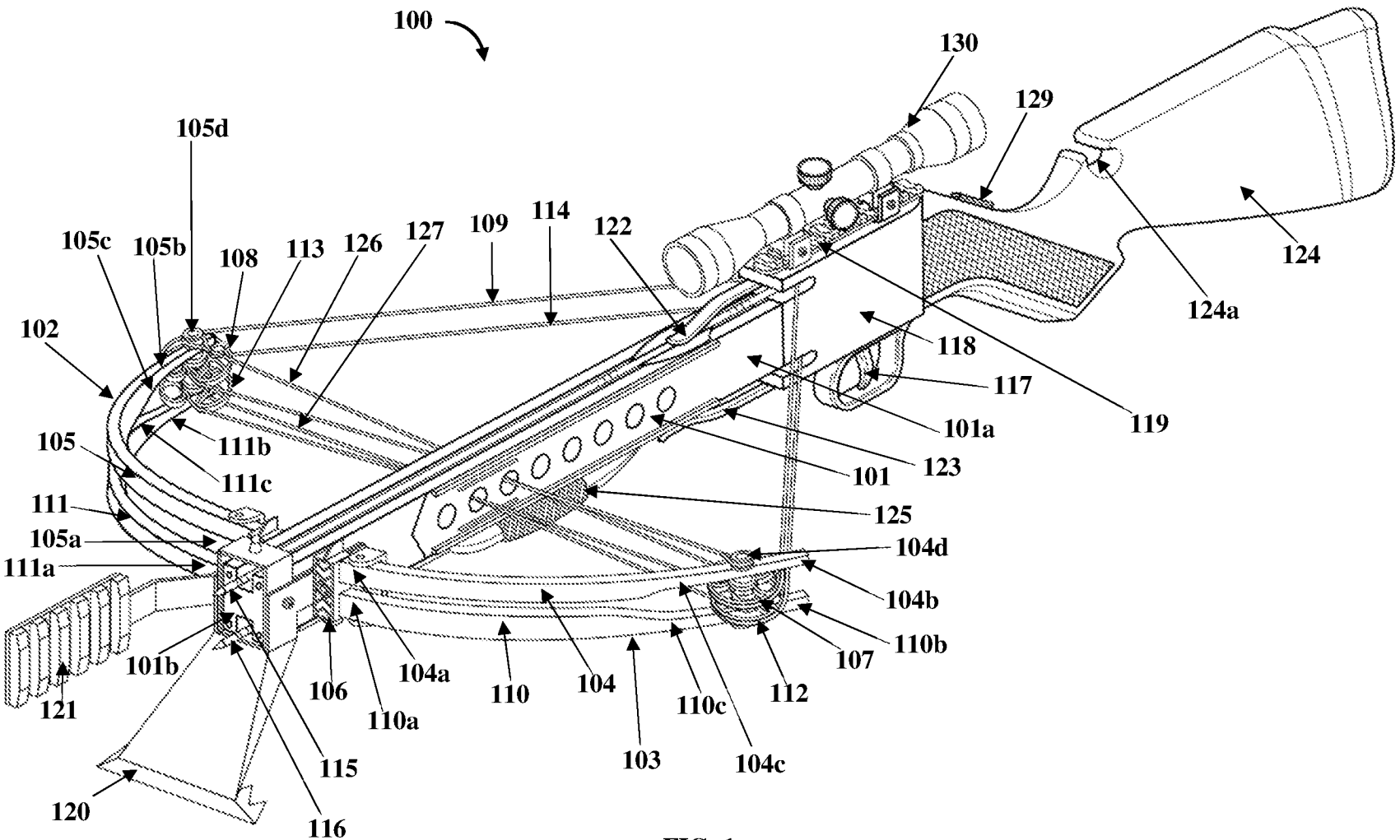
FIG. 1 exemplarily illustrates a front top perspective of a double crossbow with a single trigger mechanism.

FIG. 1 exemplarily illustrates a front top perspective of a double crossbow 100 with a single trigger mechanism 118. The double crossbow 100 with a single trigger mechanism 118 disclosed herein comprises a barrel 101, an upper bow 102, a lower bow 103, and a single trigger mechanism 118. The double crossbow 100 is manufactured using one or more of wood, metals, plastic, composite and fibreglass materials, with a variety of finishes applied to the manufactured double crossbow 100. The upper bow 102 and the lower bow 103 are positioned one on top of each other at a distal end 101*b* of the barrel 101. The upper bow 102 comprises a pair of split limbs 104 and 105. The split limb 104 comprises a first end 104*a* and a second end 104*b*, and the split limb 105 comprises a first end 105*a* and a second end 105*b*. The double crossbow 100 further comprises a riser 106 to receive the first ends 104*a* and 105*a* of the pair of split limbs 104 and 105. The upper bow 102 further comprises cams 107 and 108. The cams 107 and 108 are affixed to the second ends 104*b* and 105*b*, respectively, of each of the split limbs 104 and 105 of the upper bow 102. The upper bow 102 further comprises a first cable 126 affixed to the second ends 104*b* and 105*b* of each of the split limbs 104 and 105, and a first string 109 extending from the cams 107 and 108 of the upper bow 102 to a top sear 801 of the single trigger mechanism 118, as exemplarily illustrated in FIG. 8. The first cable 126 works in tandem with the cams 107 and 108 of the upper bow 102 to adjust the shooting power of the upper bow 102.

The lower bow 103 comprises a pair of split limbs 110 and 111. The split limb 110 comprises a first end 110*a* and a second end 110*b*. The split limb 111 comprises a first end 111*a* and a second end 111*b*. The riser 106 receives the first ends 110*a* and 111*a* of the pair of split limbs 110 and 111. The lower bow 103 further comprise cams 112 and 113. The cams 112 and 113 are affixed to the second ends 110*b* and 111*b*, respectively, of each of the split limbs 110 and 111 of the lower bow 103. The lower bow 103 further comprises a second cable 127 affixed to the second ends 110*b* and 111*b* of each of the split limbs 110 and 111 of the lower bow 103, and a second string 114 extending from the cams 112 and 113 of the lower bow 103 to a bottom sear 802 of the single trigger mechanism 118, as exemplarily illustrated in FIG. 8. The second cable 127 works in tandem with the cams 112 and 113 of the lower bow 103 to adjust the shooting power of the lower bow 103.

As illustrated in FIG. 1, the second ends 104*b* and 105*b*, of each of the split limbs 104 and 105 of the upper bow 102 comprise slots 104*c* and 105*c*, respectively which define mounting forks, for mounting axle pins 104*d* and 105*d*. The cams 107 and 108 of the upper bow 102 are concentrically mounted on the axle pins 104*d* and 105*d*, respectively, for rotation about axle pins 104*d* and 105*d*. As illustrated in FIGS. 1 and 3, the second ends 110*b* and 111*b*, of each of the split limbs 110 and 111 of the lower bow 103 comprise slots 110*c* and 111*c*, respectively which define mounting forks, for mounting axle pins 110*d* and 111*d*. The cams 112 and 113 of the lower bow 103 are concentrically mounted on the axle pins 110*d* and 111*d*, respectively, for rotation about axle pins 110*d* and 111*d*. Also, as illustrated in FIGS. 1-4, the cam 107 affixed to the second end 104*b* of the upper limb 104 and the cam 112 affixed to the second end 110*b* of the lower limb 110 face each other and are concentric to each other. Similarly, the cam 108 affixed to the second end 105*b* of the upper limb 105 and the cam 113 affixed to the second end 111*b* of the lower limb 111 face each other and are concentric to each other.

Figure 8:
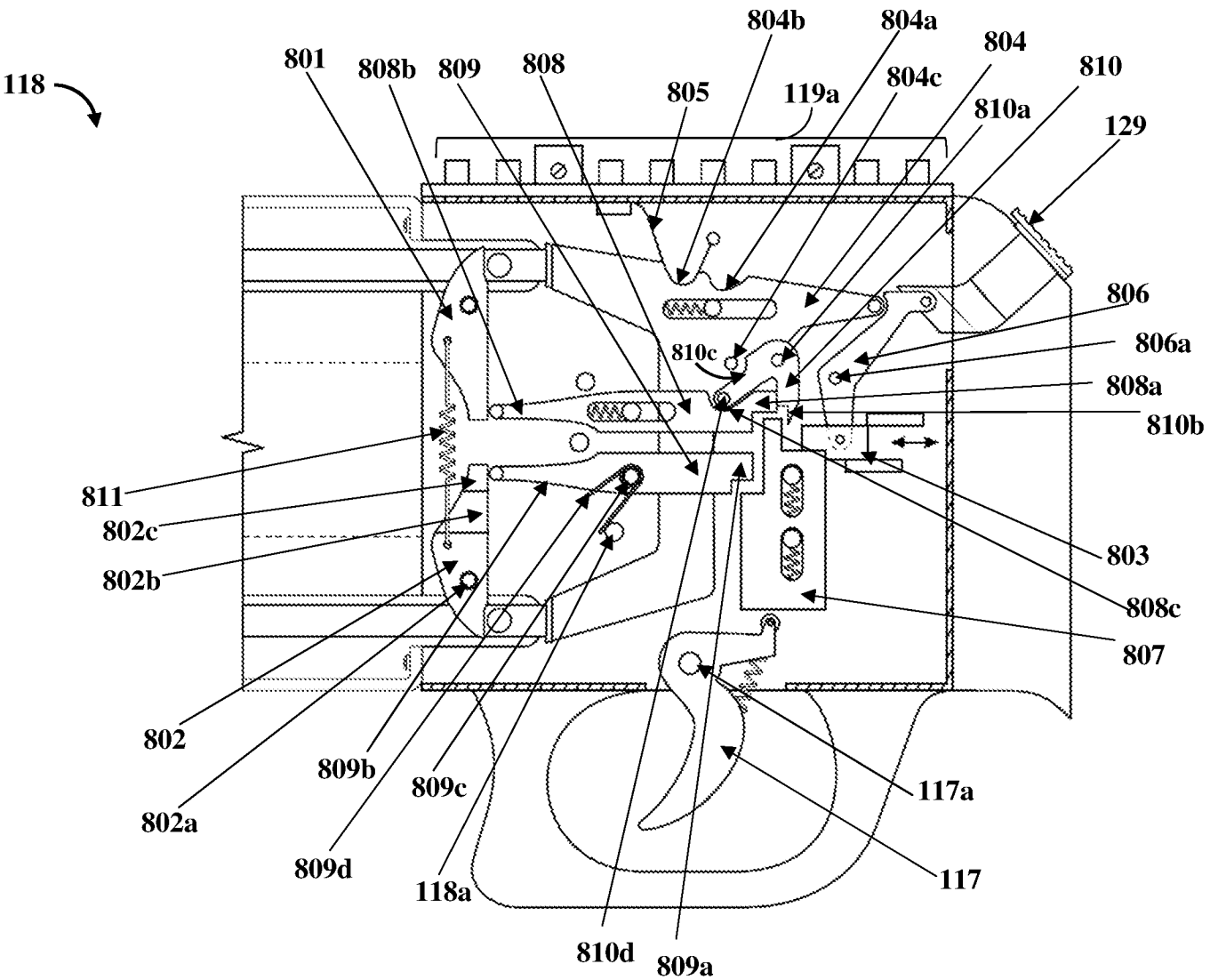
FIG. 8 exemplarily illustrates a single trigger mechanism of the double crossbow.

The double crossbow 100 further comprises a cocking rope (not shown) configured to cock the first string 109 of the upper bow 102 and the second string 114 of the lower bow 103 to the top sear 801 and the bottom sear 802 of the single trigger mechanism 118. The cocking rope is held in position in a rope slot 124*a* provided on a stock 124 of the double crossbow 100. In an embodiment, to cock the first string 109 of the upper bow 102, the double crossbow 100 is placed vertically on a ground surface with the stirrup 120 resting on the ground surface. The archer places one of his foot on the stirrup 120 and puts his weight on the stirrup 120. A mid-section of the cocking rope is passed through the rope slot 124*a*. One end of the cocking rope is looped around a portion of the first string 109 proximal to the second end 105*b* of the split limb 105 and another end of the cocking rope is looped around a portion of the first string 109 proximal to the second end 104*b* of the split limb 104. Both the ends of the cocking rope are then simultaneously pulled towards the stock 124. The first string 109 is pulled over the top sear 801 and released to cock the first string 109 of the upper bow 102 to the top sear 801. The cocking rope is used to similarly cock the second string 114 of the lower bow 103 to the bottom sear 802. As illustrated in FIG. 1, the first arrow 115 is loaded into the upper bow 102 disposed on top of the barrel 101, and the second arrow 116 is loaded into the lower bow 103 disposed at the bottom of the barrel 101. The first arrow 115 and the second arrow 116 can be loaded singularly in the double crossbow 100 and one of the first arrow 115 and the second arrow 116 is shot when the single trigger 117 is squeezed. When the first arrow 115 is loaded into the upper bow 102 or when the second arrow 116 is loaded into the lower bow 103, the arrows 115 and 116 push a safety transfer plate 804, shown in FIG. 8. The safety transfer plate 804 pushes the safety catch lever 806 causing a locator spring 805 to shift from a first groove 804*a* to a second groove 804*b* on the safety transfer plate 804. The safety transfer plate 804 also pushes the interference block 810 back into a pre-firing position which vertically aligns a sharp end 810*b* of the interference block 810, as shown in FIG. 8. The interference block 810 rotates about a pin 810*a*, in an anticlockwise direction to vertically align the sharp end 810*b* of the interference block 810. The safety transfer plate 804 overcomes the locator spring 805 while engaging the interference block 810 via a pin 804*c* impinging on a cam surface 810*c* on the interference block 810 to positively engage the interference block 810 in a safe position.

The interference block 810 comprises an interference block pin 810*d*. The interference block pin 810*d* engages with the top release bar 808, via a cam surface 808*c* on the top release bar 808 and the top release bar 808 is pushed up to engage with the top sear 801. When the second string 114 is pulled into the trigger mechanism 118 using the cocking rope, the second string 114 string rides over the bottom sear 802, rotating the bottom sear 802 in an anticlockwise direction to allow the bottom release bar 809 to move into place under the force of a bottom release bar spring 809*d*. The bottom release bar spring 809*d* is secured to the bottom release bar 809 through a pin 809*c* that goes through the bottom release spring 809*d* and the bottom release bar 809. One end of the bottom release bar spring 809*d* pushes against a pin 118*a*, shown in FIG. 8, and another end of the bottom release spring 809*d* pushes up against a second end 809*b* of the bottom release bar 809. The bottom release bar spring 809*d* is configured to maintain the bottom release bar 809 on a horizontal level when the second string 114 is engaged in the trigger mechanism 118. The bottom release bar spring 809*d* is configured to bend under and then back out from the bottom release bar 809 when the second end 809*b* of the bottom release bar 809 rotates in an anticlockwise direction during shooting of the second arrow 116, and then down and back to avoid jamming on the trigger 118 during operation.

The single trigger mechanism 118 is positioned at a proximal end 101*a* of the barrel 101 and is configured to shoot two arrows 115 and 116 in succession without reloading an arrow between two shots. The top sear 801 and the bottom sear 802 of the trigger mechanism 118, exemplarily illustrated in FIG. 8, are configured to hold the first string 109 and the second string 114 before shooting. The first arrow 115 is shot from the upper bow 102 when a single trigger 117 of the single trigger mechanism 118 is squeezed completely a first time, as exemplarily illustrated in FIG. 2. The top sear 801 holding the first sting 109 is disengaged when the single trigger 117 of the single trigger mechanism 118 is squeezed completely the first time. The second arrow 116 is shot from the lower bow 103 when the single trigger 117 of the single trigger mechanism 118 is squeezed completely a second time. The bottom sear 802 holding the second sting 114 is disengaged when the single trigger 117 of the single trigger mechanism 118 is squeezed completely the second time. The single trigger mechanism 118 is configured not to shoot the first arrow 115 and the second arrow 116 simultaneously, as explained in detailed description of FIG. 8. The double crossbow 100 further comprises a safety catch (not shown) to prevent the first arrow 115 and the second arrow 116 from being released accidentally.

Figure 2:
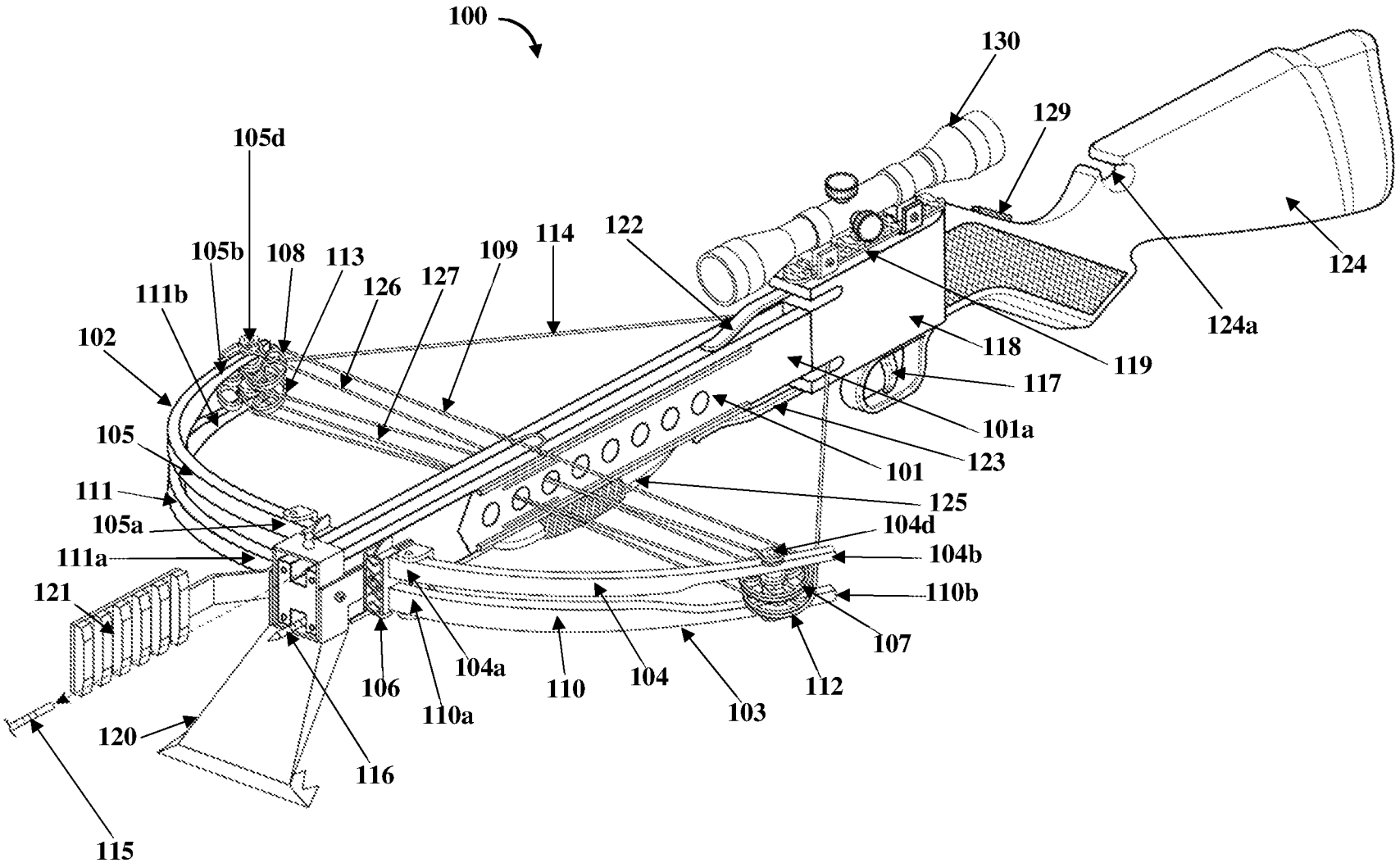
FIG. 2 exemplarily illustrates a front top perspective of a double crossbow after shooting a first arrow.
Figure 3:
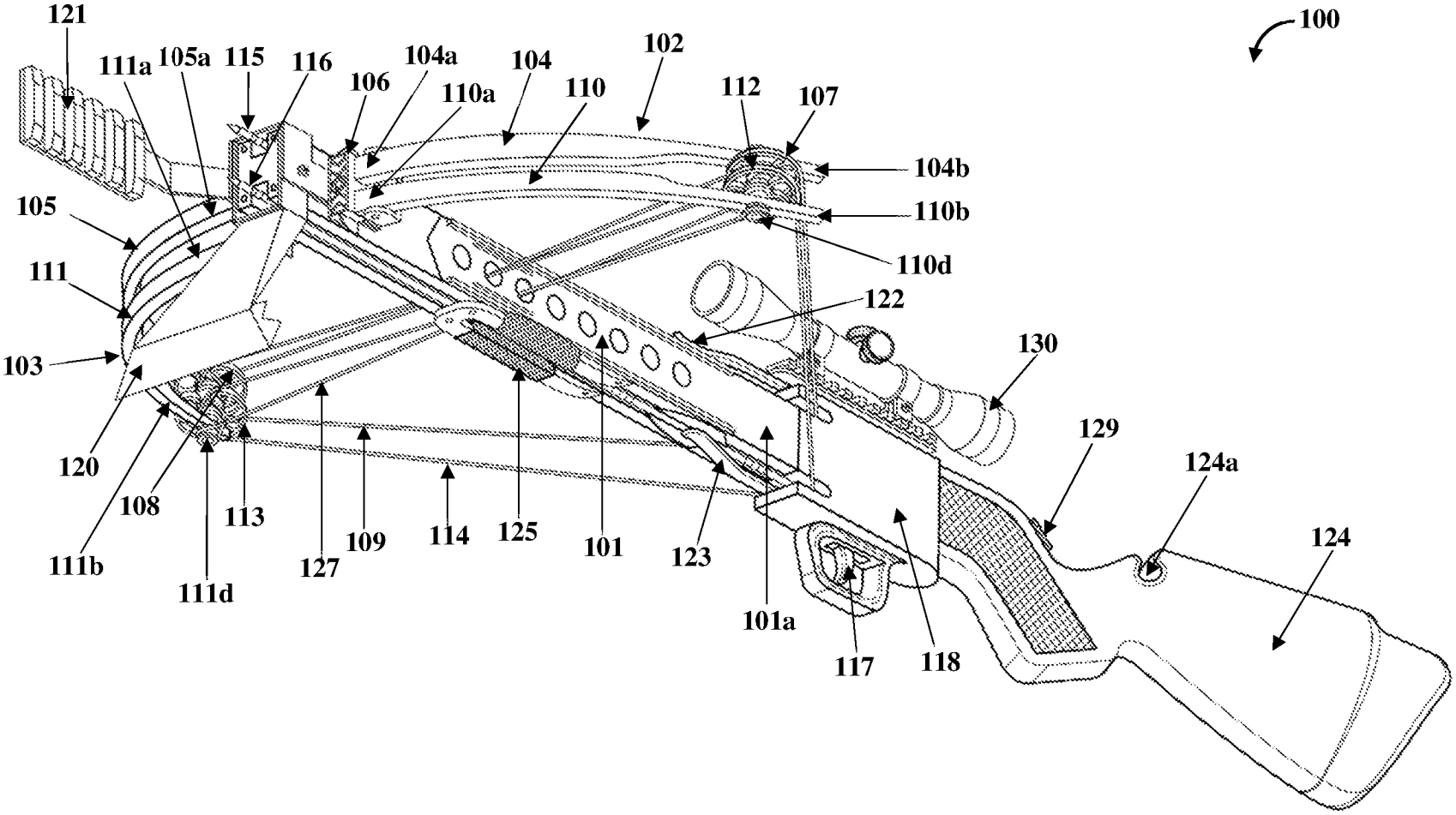
FIG. 3 exemplarily illustrates a front bottom perspective of a double crossbow with a single trigger mechanism.

As illustrated in FIGS. 1 and 2, the double crossbow 100 further comprises a sight bridge 119, a stirrup 120, a quiver 121, a pair of retention springs 122 and 123, a stock 124, and a foregrip 125. The sight bridge 119 comprises a telescopic sight 130 attached to the sight bridge 119, as shown in FIG. 1. The telescopic sight 130 is used for accurately aiming the double crossbow 100 at a target before shooting the first and second arrows 115 and 116. The stirrup 120 is used by the archer hold a foot of the archer when the cocking rope (not shown) is used for the cocking of the upper bow 102 and the lower bow 103 to the sears 801 and 802 in the single trigger mechanism 118. The quiver 121 is configured to hold a plurality of arrows. The pair of retention springs 122 and 123 are configured to hold the first arrow 115 and the second arrow 116, respectively, before shooting the first and the second arrows 115 and 116. The stock 124 is configured for holding the double crossbow 100 while shooting the first arrow 115 and the second arrow 116. The foregrip 125 is configured for holding the double crossbow 100 while aiming at a target before shooting.

FIG. 3 exemplarily illustrates a front bottom perspective of a double crossbow with a single trigger mechanism. The foregrip 125 fitted at the bottom of the barrel 101 aids the archer to keep the double crossbow 100 lined up with the target and steady archers aim.

Figure 4:
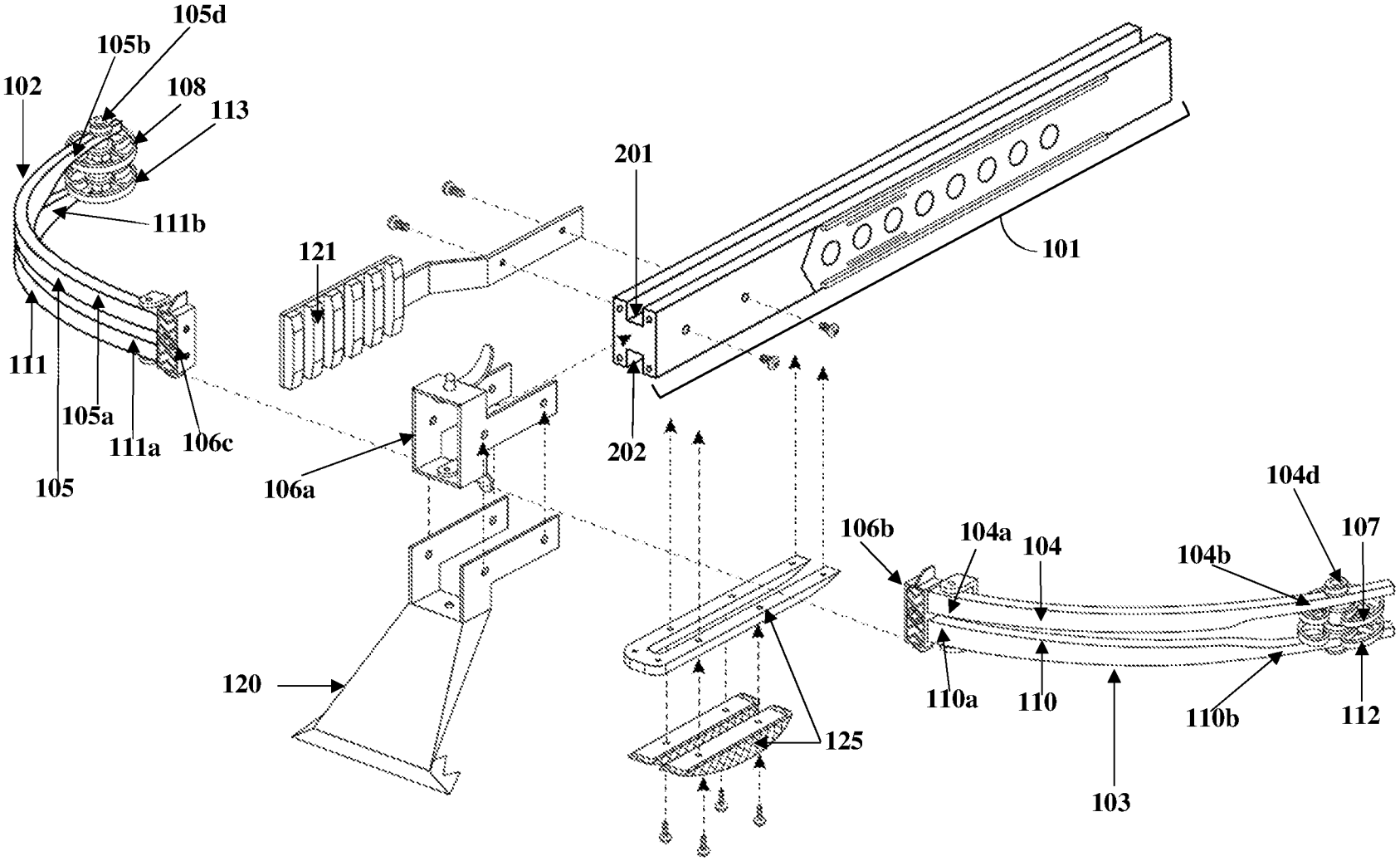
FIG. 4 exemplarily illustrates an exploded view of front section of the double crossbow.

FIG. 4 exemplarily illustrates an exploded view of front section of the double crossbow 100. The barrel 101 of the double crossbow 100 is manufactured using one or more of wood, metals, plastic, composite, carbon fibre, and fibreglass materials. The barrel 101 comprises rails 201 and 202 on its top and bottom surface for slotting in the first arrow 115 and the second arrow 116 into the upper bow 102 and the lower bow 103 respectively. The track 201 on the top of the barrel 101 aligns the first arrow 115 and the first string 109 of the upper bow 102. The track 202 on the bottom of the barrel 101 aligns the second arrow 116 and the second string 114 of the lower bow 103. The upper bow 102, the lower bow 103, the raiser 106, the stirrup 120, the quiver 121, and the foregrip 125 are fastened to the barrel 101 using fastening screws. As illustrated in FIG. 4, the raiser 106 comprises a central housing 106*a*, a first attachment 106*a* and a second attachment 106*b*. The central housing 106*a* is configured to attach the stirrup 102, the quiver 121, the upper bow 102 and the lower bow 103 to the barrel 101. The first attachment 106*a* is configured to attach the split limbs 105 and 111 to the barrel 101 via the central housing 106*a*. The second attachment 106*b* is configured to attach the split limbs 104 and 110 to the barrel 101 via the central housing 106*a*. In an embodiment the upper bow 102, the lower bow 103, the raiser 106, the stirrup 120, the quiver 121, and the foregrip 125 are removably attached to the barrel 101.

Figure 5:
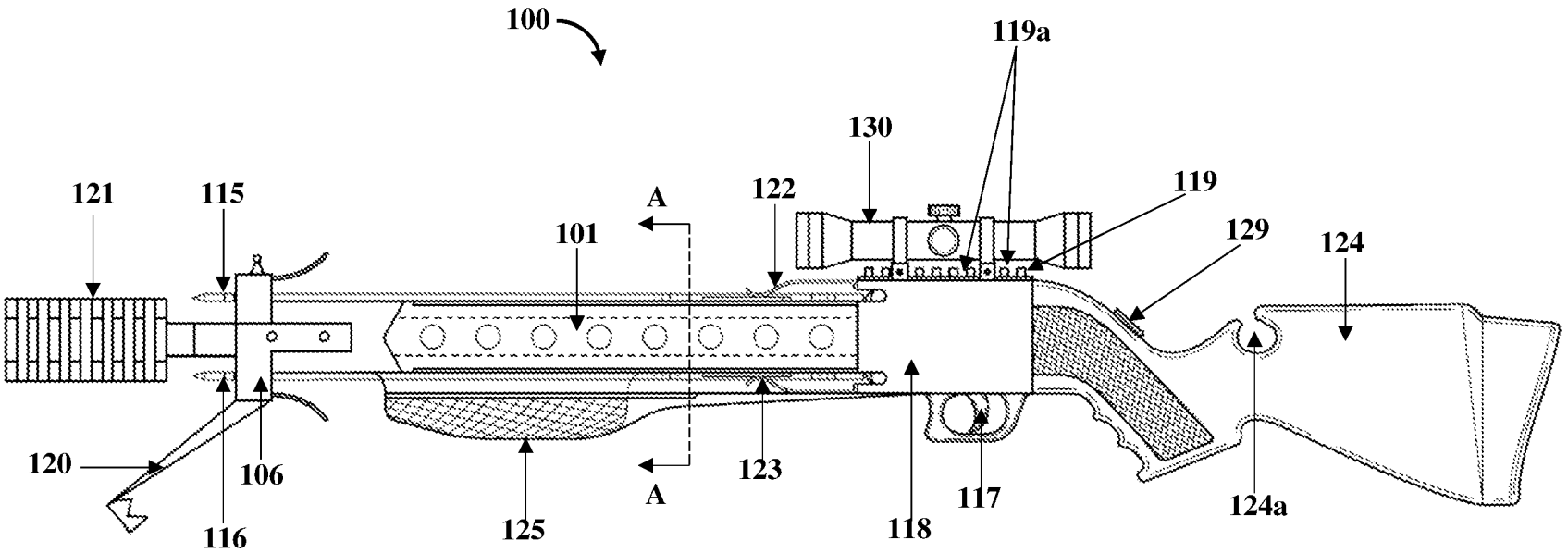
FIG. 5 exemplarily illustrates a right side view of the double crossbow.
Figure 6:
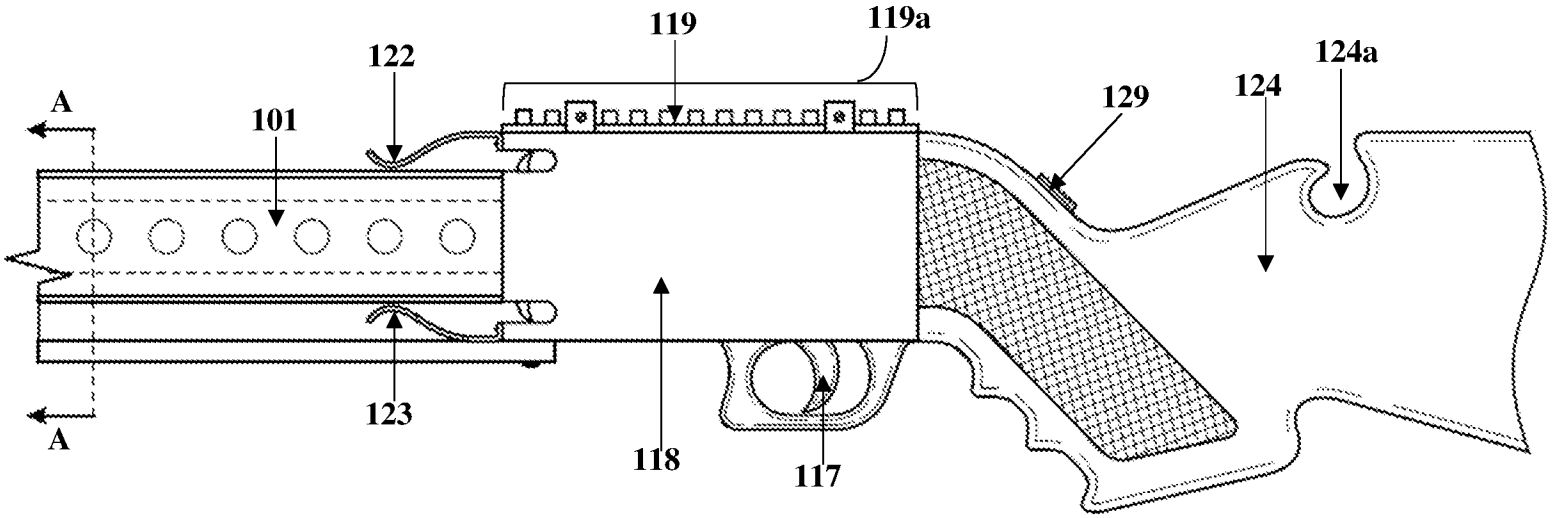
FIG. 6 exemplarily illustrates a sectional view of the double crossbow illustrated in FIG. 5.

FIG. 5 exemplarily illustrates a right side view of the double crossbow 100. The double crossbow 100 enables an archer to fire two arrows onto a target without having to reload the second arrow between shots. The archer holds the double crossbow 100 at the stock 124 while shooting the arrows 115 and 116. The stock 124 is the base of the crossbow which holds the single trigger mechanism 118 and the barrel 101. The sight bridge 119 comprises a picatinny rail system 119*a*, as shown in FIGS. 5, 6, and 8. The sight bridge 119 comprising the picatinny rail system 119*a* is disposed on top of the single trigger mechanism 118, as shown in FIG. 5. As exemplarily illustrated in FIG. 6, the picatinny rail system 119*a* of the sight bridge 119 provides a mounting platform for accessories such as telescopic sights 120, iron sights, tactical lights, laser aiming modules, night vision devices, reflex sights, foregrips, bipods, slings and bayonets, etc. The foregrip 125 fitted at the bottom of the barrel 101 further accommodates the accessories and allows the safe use of the double crossbow 100. In an embodiment the foregrip 125 is one of a collapsible foregrip and a removable foregrip. The double crossbow 100 further comprises a raised comb (not shown) positioned on top of the stock 124 to compliment fitted telescopic sight 119. The raised comb will be fitted on top of the stock 124 using slinging attachments.

Figure 7:
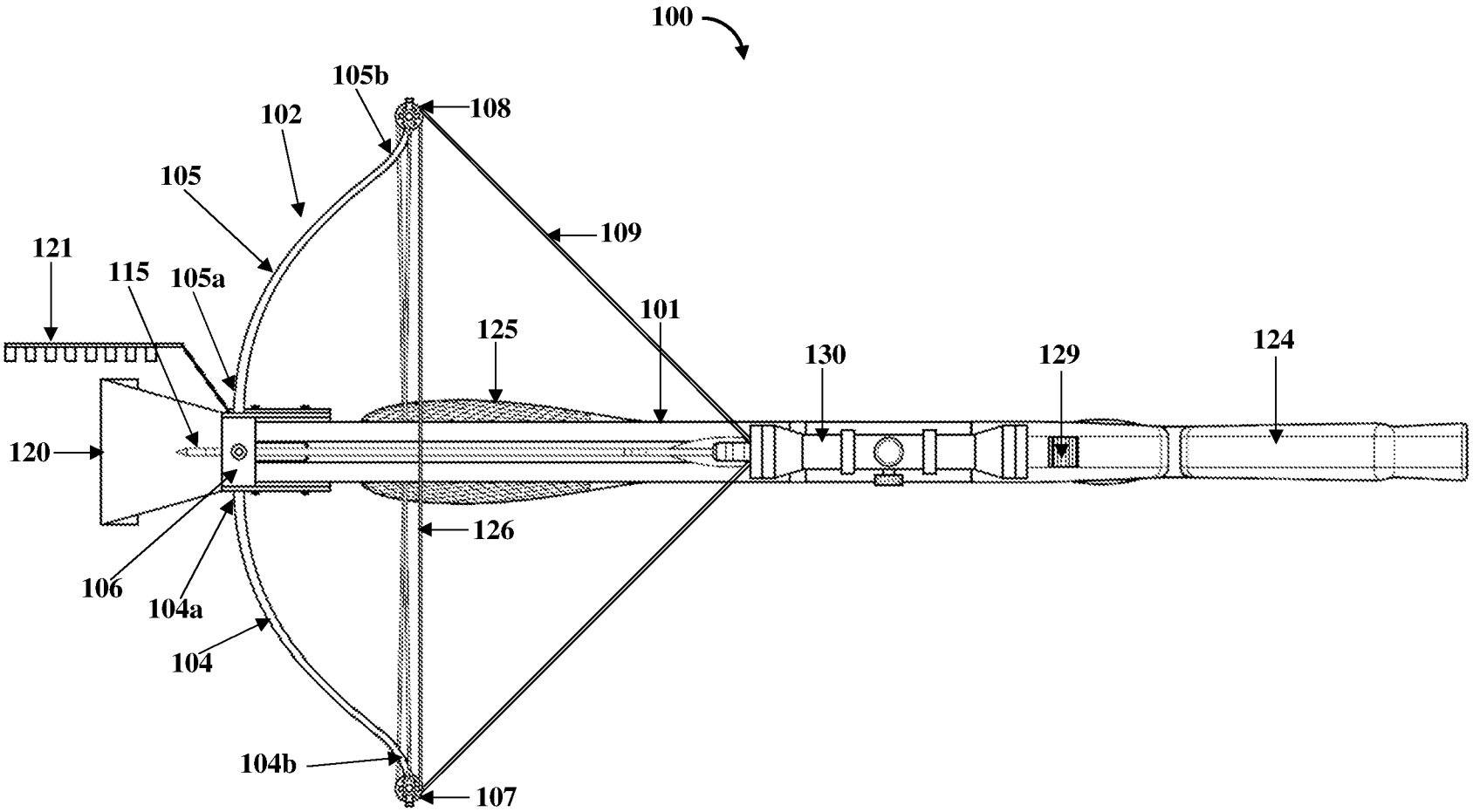
FIG. 7 exemplarily illustrates a top view of the double crossbow.

FIG. 7 exemplarily illustrates a top view of the double crossbow 100. As illustrated in FIGS. 1-4, 5 and 7, the quiver 121 is fastened to a right side of the barrel 101, proximal to the stirrup 120. The quiver 121 is angled away from the arrows 115 and 116 loaded into the double crossbow 100. The quiver 121 is also angled away from a line of sight of a telescopic sight 119 mounted on the sight bridge 119. In an embodiment, the quiver 121 is mounted at the bottom of the double crossbow 100. In another embodiment, the quiver 121 is mounted at the left side of the barrel 101 of the double crossbow 100. In another embodiment, the quiver 121 is mounted at the top of the double crossbow 100. The quiver 121 can be configured in any desired shape and size to hold a predetermined number of arrows. As illustrated in FIG. 7, the raiser 106 is first slid onto the front end 101*a* the barrel 101. The stirrup 120 is then slid on top of the raiser 106 and the quiver 121 is then slid on top of the stirrup 120. The raiser 106, the stirrup 120 and the quiver 121 are attached to the distal end 101*b* of the barrel 101, as shown in FIG. 1. The archer places his foot on the stirrup 120 to prevent the double crossbow 100 from slipping while cocking it. The stirrup 120 also protects the arrows end from damage.

FIG. 8 exemplarily illustrates a single trigger mechanism 118 of the double crossbow 100. The single trigger mechanism 118 is positioned at a proximal end 101*a* of the barrel 101 and is configured to shoot two arrows 115 and 116 in succession without reloading a second arrow between two shots. The single trigger mechanism 118 comprises a top sear 801, a bottom sear 802, a safety catch lever extension 129 attached to a safety catch lever 806, a safety transfer plate 804, a locator spring 805, a safety catch block 803, a trigger block 807, a top release bar 808, a bottom release bar 809, an interference block 810, a sear spring 811, and a bottom release bar spring 812. The safety catch lever 806 connects the safety catch lever extension 129, the safety transfer plate 804, and the safety catch block 803. When the bow, for example, the upper bow 102 is cocked, the first bow string 109 is pushed against the safety transfer plate 804, which, in turn pushes the safety catch block 803 and simultaneously pushes the safety catch lever extension 129 out to reflect the safe position. The safety transfer plate 804 also pushes the interference block 810, anticlockwise via the pin 804*c*, engaging on the cam surface 810*c* on the interference block 810, and pushes the safety catch lever 806, which, in turn causes the safety catch block 803, to engage the trigger block 807.

When both bows 102 and 103 are cocked, the top sear 801 and the bottom sear 802 holds the first string 109 and the second string 114 in place respectively before shooting the first and second arrows 115 and 116. The safety catch block 803 is configured to prevent the first arrow 115 and the second arrow 116 from being released when the safety catch block 803 is activated by sliding the safety catch block 803 forward to block an upward movement of the trigger block 807. The safety catch block 803 is further configured to be deactivated by sliding the safety catch block 803 backwards to unblock or allow an upward movement of the trigger block 807. The safety catch block 803 slides forward when the archer pushes the safety catch lever extension 129 forward and the safety catch block 803 slides backwards when the archer pushes the safety catch lever extension 129 forward. The safety catch is further configured to allow release of the first arrow 115 when deactivated and when the single trigger 117 of the single trigger mechanism 118 is squeezed completely a first time. The safety catch is further configured to allow release of the second arrow 116 when deactivated and when the single trigger 117 of the single trigger mechanism 118 is released and squeezed completely a second time. The safety transfer plate 804 is configured to be pushed forward when the safety catch is deactivated by pushing it forward, through the action of safety catch lever 806.

The safety transfer plate 804 overcomes a locator spring 805 when pushed forward and causes the safety catch lever 806 to rotate about pin 806*a* and cause the safety catch block 803 to disengage from the trigger block 807, allowing the trigger block 807 to rise when the single trigger 117 of the single trigger mechanism 118 is pulled for the first time. The single trigger 117 rotates in an anticlockwise direction about a pivot pin 117*a* when the trigger 117 is pushed. The trigger block 807 is configured to rise and push up against a first end 808*a* of a top release bar 808 when the single trigger 117 of the trigger mechanism 118 is completely squeezed for the first time, causing a second end 808*b* of the top release bar 808 to move down and disengage from the top sear 801, enabling the top sear 801 to rotate freely, enabling the first string 109 to be pulled out over the top sear 801 and release the first arrow 115 out onto a target. The trigger block 807 is stopped from further rising up when it comes into contact with an interference block 810. The interference block 810 starts to rotate about the pin 810*a*, in a clockwise direction, but the interference block 810 is precluded from fully rotating when the sharp end 810*b* of the interference block 810 impinges on a side of the trigger block 807. When the single trigger 117 is released after shooting the first arrow 115, the trigger block 807 will move down and disengage from the interference block 810*b*, allowing the interference block 810 to rotate about the pin 810*a*, in a clockwise direction, under an internal spring pressure and creates space for further travel of the trigger block 807 on a second pull of the single trigger 117.

The single trigger 117 of the trigger mechanism 118 when completely squeezed for the second time, causes the interference block 810 to rise again. When the interference block 810 rises, the interference block 810 pushes up against a first end 809*a* of a bottom release bar 809. The bottom release bar 809 rotates in an anticlockwise direction about the pin 809*c*, and the second end 809*b* of the bottom release bar 809 disengages from the bottom sear 802 and slots into a slot 802*b* located proximal to a first end 802*c* of the bottom sear 802. The bottom sear 802 after disengaging from the bottom release bar 809 rotates in a clockwise direction about pin 802*a*. When the bottom sear 802 freely rotates in the clockwise direction about pin 802*a* after disengaging from the bottom release bar 809, the second string 114 is pulled out over the bottom sear 802 and the second arrow 116 is released onto the target. The trigger mechanism 118 is reset when the first string 109 and the second string 114 are re-cocked using a cocking rope. The safety catch is activated after resetting the trigger mechanism 118 by pulling back the safety catch from its pushed forward position. The single trigger mechanism 118 is configured to not shoot the first arrow 115 and the second arrow 116 simultaneously. The safety catch of the double crossbow 100 prevents the first arrow 115 and the second arrow 116 from being released accidentally.

Figure 9A:
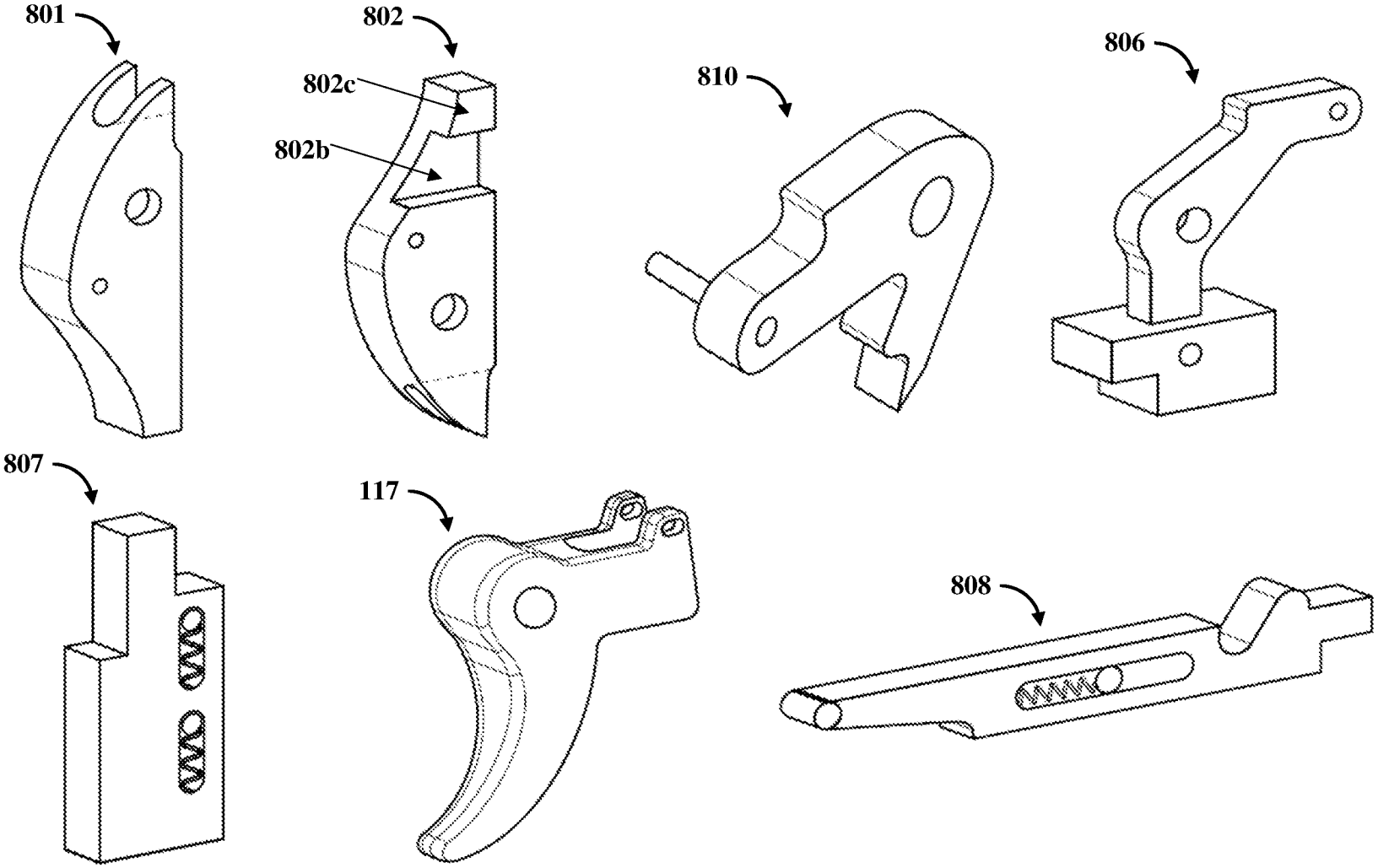
Figure 9C:
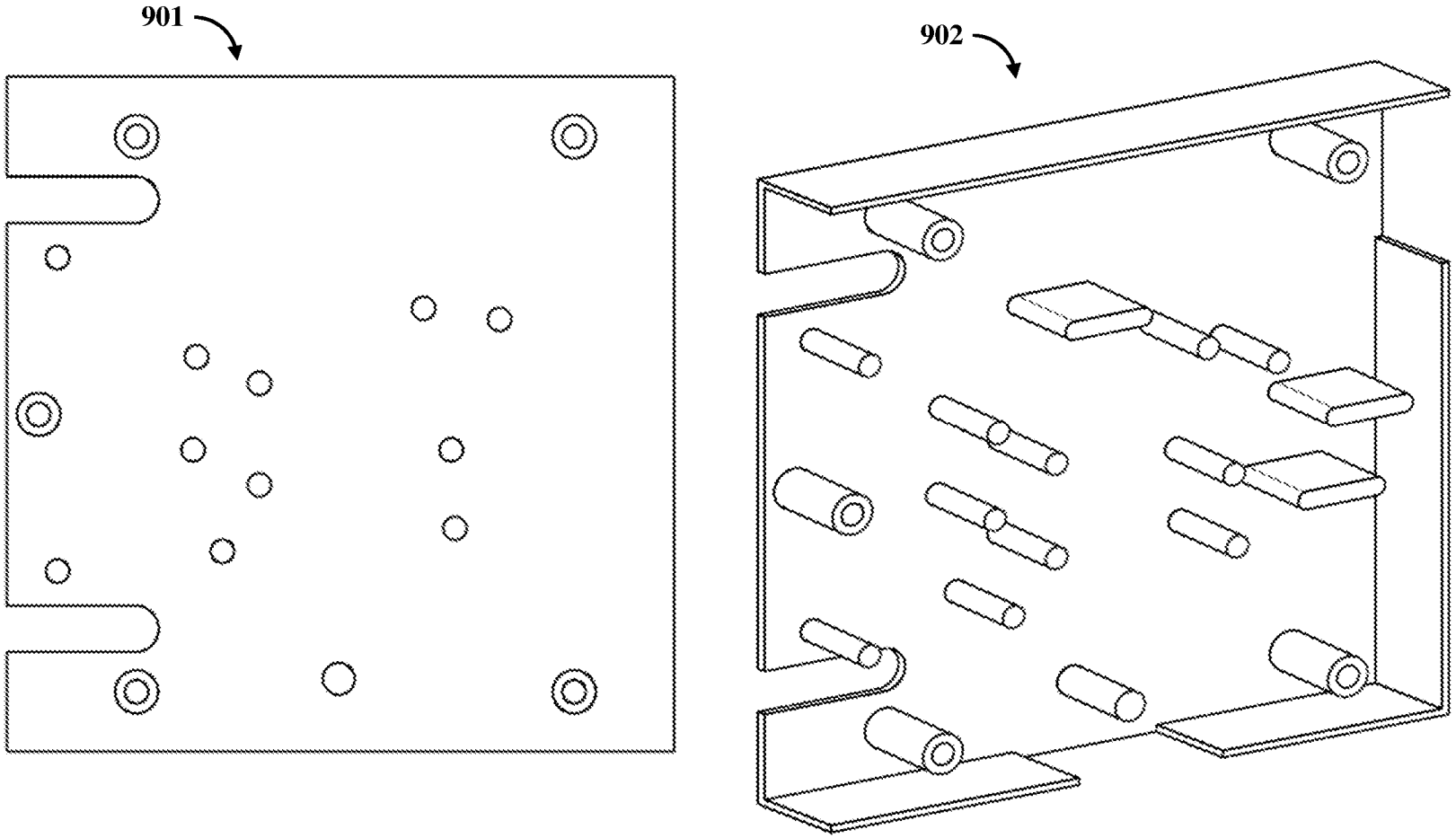

FIGS. 9A-9C exemplarily illustrate the following components: the top sear 801, the bottom sear 802, the safety transfer plate 804, the locator spring 805, the safety catch lever 806, the trigger block 807, the top release bar 808, the bottom release bar 809, the interference block 810, and the trigger 117, of a single trigger mechanism 118.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

I claim:

1. A double crossbow with a single trigger mechanism, said double crossbow comprising:

a barrel;

an upper bow and a lower bow positioned one on top of each other at a distal end of said barrel; and a single trigger mechanism positioned at a proximal end of said barrel, said trigger mechanism configured to shoot a first arrow and thereafter to shoot a second arrow, wherein the first arrow is shot from said upper bow when a single trigger of said single trigger mechanism is squeezed completely a first time, and wherein the second arrow is shot from said lower bow when said single trigger of said single trigger mechanism is squeezed completely a second time, wherein said single trigger mechanism comprises:

a safety catch configured to preclude said first arrow and said second arrow from being released when said safety catch is activated, said safety catch further configured to be deactivated when pushed forward, said safety catch further configured to release said first arrow when deactivated and when said single trigger of said single trigger mechanism is squeezed completely a first time, and said safety catch further configured to allow release of said second arrow when deactivated and when said single trigger of said single trigger mechanism is squeezed completely a second time;

a safety transfer plate configured to be pushed forward when said safety catch is deactivated by pushing it forward, wherein said pushing forward of said safety transfer plate overcomes a locator spring and causes a safety catch lever to rotate and cause a safety catch block to disengage from a trigger block, allowing said trigger block to rise when said single trigger of said single trigger mechanism is pulled the first time;

said trigger block configured to rise and push up a first end of a top release bar when said single trigger of said trigger mechanism is completely squeezed the first time, causing a second end of said top release bar to move down and disengage from said top sear, enabling said top sear to rotate freely, and enabling said first string to be pulled out over said top sear and release said first arrow to a target;

said trigger block further configured to stop rising when it comes in contact with an interference block, wherein said interference block starts to rotate but is precluded from fully rotating by impingement of the interference block on a side of said trigger block, wherein when said single trigger is released after shooting said first arrow, said interference block continues to rotate under an internal spring pressure and creates space for further travel of said trigger block on a second pull of said single trigger; and said single trigger of said trigger mechanism when completely squeezed for the second time, causes said interference block to rise again, wherein when said interference block rises, said interference block pushes up a bottom release bar which rotates and disengages said bottom sear which becomes free to rotate, wherein when said bottom sear freely rotates, said second string is pulled out over said bottom sear and said second arrow is released onto said target.

2. The double crossbow of claim 1, wherein said upper bow comprises a pair of split limbs with a first end and a second end, a riser to receive said first end of said pair of split limbs, a cam affixed to said second end of each of said split limbs of said upper bow, a first cable affixed to said second end of each of said split limbs of said upper bow, and a first string extending from said cams of said upper bow to a top sear of said single trigger mechanism.

3. The double crossbow of claim 2, wherein said first cable works in tandem with said cams of said upper bow to adjust the shooting power of said upper bow.

4. The double crossbow of claim 1, wherein said lower bow comprises a pair of split limbs with a first end and a second end, a riser to receive said first end of said pair of split limbs, a cam affixed to said second end of each of said split limbs of said lower bow, a second cable affixed to said second end of each of said split limbs of said lower bow, and a second string extending from said cams of said lower bow to a bottom sear of said single trigger mechanism.

5. The double crossbow of claim 4, wherein said second cable works in tandem with said cams of said lower bow to adjust the shooting power of said lower bow.

6. The double crossbow of claim 1, wherein said first arrow is loaded into said upper bow disposed on top of said barrel, and said second arrow is loaded into said lower bow disposed at bottom of said barrel.

7. The double crossbow of claim 1, wherein one of said first arrow and said second arrow is loaded singularly in said double crossbow, and said one of said first arrow and said second arrow is shot when said single trigger is squeezed.

8. The double crossbow of claim 1, wherein said single trigger mechanism is configured to not shoot said first arrow and said second arrow simultaneously.

9. The double crossbow of claim 1, further comprising a safety catch to prevent said first arrow and said second arrow from being released accidentally.

10. The double crossbow of claim 1, further comprising a telescope attachment with a sight bridge configured for aiming a target before shooting said first and second arrows.

11. The double crossbow of claim 1, wherein said single trigger mechanism comprises a top sear and a bottom sear, wherein said top sear is configured to hold said first string before shooting said first arrow and said bottom sear is configured to hold said second string before shooting said second arrow.

12. The double crossbow of claim 11, further comprising a cocking rope configured to cock said first string of said upper bow and said second string of said lower bow to said top and bottom sears of said single trigger mechanism.

13. The double crossbow of claim 12, further comprising a stirrup configured to hold a foot of an archer when said cocking rope is used for said cocking of said upper bow and said lower bow to said top and bottom sears of said single trigger mechanism.

14. The double crossbow of claim 1, further comprising a quiver configured to hold a plurality of arrows, and further comprising a pair of retention springs configured to hold said first arrow and said second arrow before shooting said first arrow and said second arrow.

15. The double crossbow of claim 1, further comprising a stock configured for holding said double crossbow while shooting said first arrow and said second arrow, and further comprising a foregrip configured for holding said double crossbow while aiming at a target before shooting.

16. The double crossbow of claim 1, wherein said barrel comprises rails on its top and bottom surface for slotting in said first arrow and said second arrow into said upper bow and said lower bow respectively.

17. The double crossbow of claim 1, wherein said double crossbow is manufactured using one or more of wood, metals, plastic, composite and fibreglass materials, with a variety of finishes applied to said manufactured double crossbow.

18. The double crossbow of claim 1, wherein said trigger mechanism is reset when said first string and said second string are re-cocked using a cocking rope, and wherein said safety catch is activated after resetting said trigger mechanism by pulling back said safety catch from its pushed forward position.

19. A single trigger mechanism for double crossbow, comprising:

a top sear and a bottom sear for holding a first string and a second string of said double crossbow in place respectively before shooting a first arrow and a second arrow;

a safety catch configured to prevent said first arrow and said second arrow from being released when said safety catch is activated, said safety catch further configured to be deactivated when pushed forward, said safety catch further configured to allow release of said first arrow when deactivated and when a single trigger of said single trigger mechanism is squeezed completely a first time, and said safety catch further configured to allow release of said second arrow when deactivated and when said single trigger of said single trigger mechanism is squeezed completely a second time;

a safety transfer plate configured to be pushed forward when said safety catch is deactivated by pushing it forward, wherein said pushing forward of said safety transfer plate overcomes a locator spring and causes a safety catch lever to rotate and cause a safety catch block to disengage from a trigger block, allowing said trigger block to rise when said single trigger of said single trigger mechanism is pulled for the first time;

said trigger block configured to rise and push up a first end of a top release bar when said single trigger of said trigger mechanism is completely squeezed for the first time, causing a second end of said top release bar to move down and disengage from said top sear, enabling said top sear to rotate freely, enabling said first string to be pulled out over said top sear and release said first arrow out onto a target;

said trigger block further configured to stop rising when it comes into contact with an interference block, wherein said interference block starts to rotate but is precluded from fully rotating by impingement of the interference block on a side of said trigger block, wherein when said single trigger is released after shooting said first arrow, said interference block continues to rotate under an internal spring pressure and creates space for further travel of said trigger block on a second pull of said single trigger; and said single trigger of said trigger mechanism when completely squeezed for the second time, causes said interference block to rise again, wherein when said interference block rises, said interference block pushes up a bottom release bar which rotates and disengages said bottom sear which becomes free to rotate, wherein when said bottom sear freely rotates, said second string is pulled out over said bottom sear and said second arrow is released onto said target.

* * * * *